US005984837A

United States Patent [19]

Weaver et al.

[11] Patent Number: 5,984,837

[45] Date of Patent: Nov. 16, 1999

[54] TENSIONED FLOOR SYSTEM

[75] Inventors: Howard W. Weaver, New Franklin; Darrell A. Weaver, Sedalia, both of Mo.

[73] Assignee: PlaySmart, Inc., Sedalia, Mich.

[21] Appl. No.: 09/073,497

[22] Filed: May 6, 1998

Related U.S. Application Data

[63] Continuation-in-part of application No. 08/505,011, Jul. 21, 1995, Pat. No. 5,795,267.

[51] Int. Cl.[6] ..... A63B 9/00

[52] U.S. Cl. ..... 482/35; 482/27; 24/265 C; 24/265 AL; 52/222; 52/664; 182/139; 160/378; 160/388; 160/DIG. 15; 135/116; 135/119

[58] Field of Search ..... 482/23, 35, 26–29, 482/36; 24/32, 38, 31 B, 68 R, 68 BT, 68 D, 182, 265 C, 265 AL, 265 BC, 573.1; 297/452.63, 452.64; 52/63, 222, 660, 662, 664; 5/191; 182/138, 139; 160/383, 388, 389, 378, 328, DIG. 15; 135/115, 116, 119; 248/505; 114/61.23, 85, 39.26; 108/158.11

[56] References Cited

U.S. PATENT DOCUMENTS

| | | | |
|---|---|---|---|
| 173,066 | 2/1876 | Salmon et al. | 24/265 AL |
| 1,876,383 | 9/1932 | Anderson | 24/265 BC |
| 2,196,704 | 4/1940 | Markle | 135/115 |
| 3,255,115 | 6/1966 | Peterson | 482/148 |
| 3,438,099 | 4/1969 | Green | 24/265 C |
| 3,913,598 | 10/1975 | Glutting, Jr. et al. | 135/119 |
| 4,685,738 | 8/1987 | Tinus | 297/452.64 |
| 5,738,160 | 4/1998 | Rice | 160/378 |
| 5,795,267 | 8/1998 | Weaver | 482/35 |

FOREIGN PATENT DOCUMENTS

| | | | |
|---|---|---|---|
| 1326104 | 3/1963 | France | 52/664 |
| 99022 | 5/1923 | Switzerland | 24/265 AL |

*Primary Examiner*—Richard J. Apley
*Assistant Examiner*—Victor K. Hwang
*Attorney, Agent, or Firm*—David M. Klein; Shearman & Sterling

[57] ABSTRACT

A play system floor includes a frame defining the periphery of an area to be floored and a webbed flooring constructed of a webbing material extending between the frame members. The webbing material has an optimal predetermined stretch coefficient at which it retains its resiliency, while resisting sagging. The webbed flooring is sized using the stretch coefficient whereby the dimensions of the webbed flooring when stretched substantially correspond to the dimensions of the area to be floored. The webbed flooring is stretched to the dimensions of the area to be floored and secured to the frame. The floor is stretched to the dimensions of the area to be floored by positioning a bar through loops on each side of the weaved flooring, and applying tension to each bar. The webbed flooring is secured to the frame by attaching each bar to the frame using clamps, bands, or other attaching devices. Tension to each bar is applied by operating a screw-actuated clamping member to tighten the bar against the frame. Alternatively, a first attachment bracket is attached to an end of each webbing material and is looped around the rigid frame. A second attachment bracket is attached to each webbing material near its end but laterally spaced from the frame toward the interior of the floor area. Tension is applied to the floor by a tensioning device extending through the brackets. A drive rivet is inserted thorough holes in the brackets to secure them together with the floor tensioned.

9 Claims, 10 Drawing Sheets

TENSIONED FLOOR SYSTEM

CROSS-REFERENCE TO RELATED APPLICATION

This is a continuation-in-part of commonly owned U.S. patent application Ser. No. 08/505,011, filed Jul. 21, 1995, now U.S. Pat. No. 5,795,267.

BACKGROUND OF THE INVENTION

1. Field of the Invention

The present invention relates generally to flooring for play systems, and more particularly to a webbed floor for a play system in which the webbing is pre-tensioned, weaved, and attached to a frame by one of several attachment techniques.

2. Description of the Prior Art

Play systems for children are well-known in the art and have evolved into a major industry in the United States. A typical play system, such as shown in FIG. 1, is constructed of a tubular metal frame 2 and may include, for example, one or more enclosed or unenclosed slides 4, platforms 6 at different heights, enclosed or unenclosed passageways 8, a ball bin 10 (balls not shown), monkey bars, trolleys, and other recreational elements suitable for use by children.

The flooring for a play system must generally meet two criteria; it must be resilient so that children may play without injuring themselves, and it must be able to endure prolonged abuse by thousands of children. The simplest type of flooring for a play system is constructed of vinyl or other durable material that is attached to the frame, generally by forming a loop at the end of the flooring and sliding the frame members through the material. These types of floors suffer from several shortcomings. First, the materials used for the floor tend to stretch and sag over time, thereby requiring replacement of the flooring and resulting in loss of enjoyment of the play system by the children. Second, since the vinyl or other material is opaque, parents who are concerned about their children's safety on the upper platforms of the play system may lose sight of their children.

In an attempt to overcome these short comings, layered web floors, such as shown in FIG. 2, were developed. This type of floor consists of straps of webbing, 14 and 16, made of nylon or other material, which are oriented perpendicular to each other. At their ends, the web straps are wrapped around the frame members 12 to form a loop and are sewn to themselves. In this type of webbed flooring, all of the straps that are oriented in one direction. e.g., straps 14, are located either above or below all of the straps oriented in the other direction, e.g. straps 16. Where the straps 14 and 16 pass over each other, they are sewed together.

This type of webbed flooring also suffers from several shortcomings. First, when a child is standing on a single web strap on the lower layer of straps, the stitching that attaches the strap to the upper layer of strap bears much of the weight of the child. Consequentially, the stitching tends to tear over time, resulting in separation of the layers of the floor and requiring replacement of the floor. Second, this type of floor also tends to stretch over time, thereby requiring relatively frequent replacement.

In this type of floor, an alternative method of attaching the webs to the frame may he used. Each web may include a loop at each end formed by sewing the web to itself. The webbing is made to alternate between straps that are shorter, having a length extending approximately the length between opposed frame members, and longer length webs, sized so that the loops at the ends of the longer webs pass around the frame members and align with the loops at the ends of the shorter straps. A relatively rigid rod is then passed through the aligned loops of the shorter and longer webs. The webs passing around the frame secure the floor to the frame. These types of floors are difficult to assemble, and tend to sag due to the difficulty in tensioning the floor as a result of the difficult assembly procedure.

In order to reduce the tendency of play system floors to sag, the floor may be tensioned. One known method of tensioning the floor is to attach springs to the floor. This type of system is used, for example, in trampoline floors. Use of this type of tensioning system is not desirable because the springs are expensive and remain exposed, thereby endangering children on the play system.

In another type of tensioning system, as shown in FIGS. 3 and 4, one loop of a tensioning harness 18 is attached to a rod 20 running around the perimeter of the floor through loops in the flooring material. The other loop of the harness is attached to the frame around the base of the floor. In either of these methods, i.e., using springs or a tensioning harness, the tensioning device becomes a permanent component of the floor, thereby making such floors more expensive.

One object of the present invention is to provide a play system floor that is durable and that is pre-tensioned so as to be resistant to sagging. Another object of the present invention is to provide a plan system floor in which the tensioning device does not become a permanent part of the floor, or which utilizes inexpensive components so as to reduce the cost of such a floor.

SUMMARY OF THE INVENTION

The present invention is a play system floor which includes a frame defining the periphery of a floor and a webbed floor constructed of a webbing material extending between the frame members. The webbing material has an optimal predetermined stretch coefficient at which it retains its resiliency, while resisting sagging. The webbed flooring is sized using the stretch coefficient whereby the dimensions of the webbed flooring when stretched substantially correspond to the dimensions of the area to be floored. The webbed flooring is stretched to the dimensions of the area to be floored and secured to the frame.

The webbing material is preferably 2" wide nylon webbing. In order to increase the durability of the floor, the webs that make up the flooring are weaved and sewn together at areas where the webs overlap.

The step of stretching the webbed flooring to the dimensions of the area to be floored preferably includes positioning a relatively rigid bar through the loops on each side of the webbing material, and applying tension to each relatively rigid bar for stretching the webbed flooring to the dimensions of the frame. The step of securing the webbed flooring to the frame preferably comprises attaching each rigid bar to the frame in fixed relation thereto using clamps, bands, or other securing means. Tension to each rigid bar is applied by operating a screw-actuated clamping member to tighten the bar against the frame.

In an alternative embodiment, a first attachment bracket is attached to an end of each webbing material and is looped around the rigid frame. A second attachment bracket is attached to each webbing material near its end. Attachment means, which is preferably a drive rivet inserted through holes in the brackets, secures each first attachment bracket to a respective second attachment bracket with tension applied to the webbed flooring. A strap attaches each second attachment bracket to the webbing material. The webbing material and strap are sized whereby upon alignment of the alignment holes in the first and second attachment brackets, the webbed flooring is at a desired tension.

DESCRIPTION OF THE PREFERRED EMBODIMENT

Figure 1:
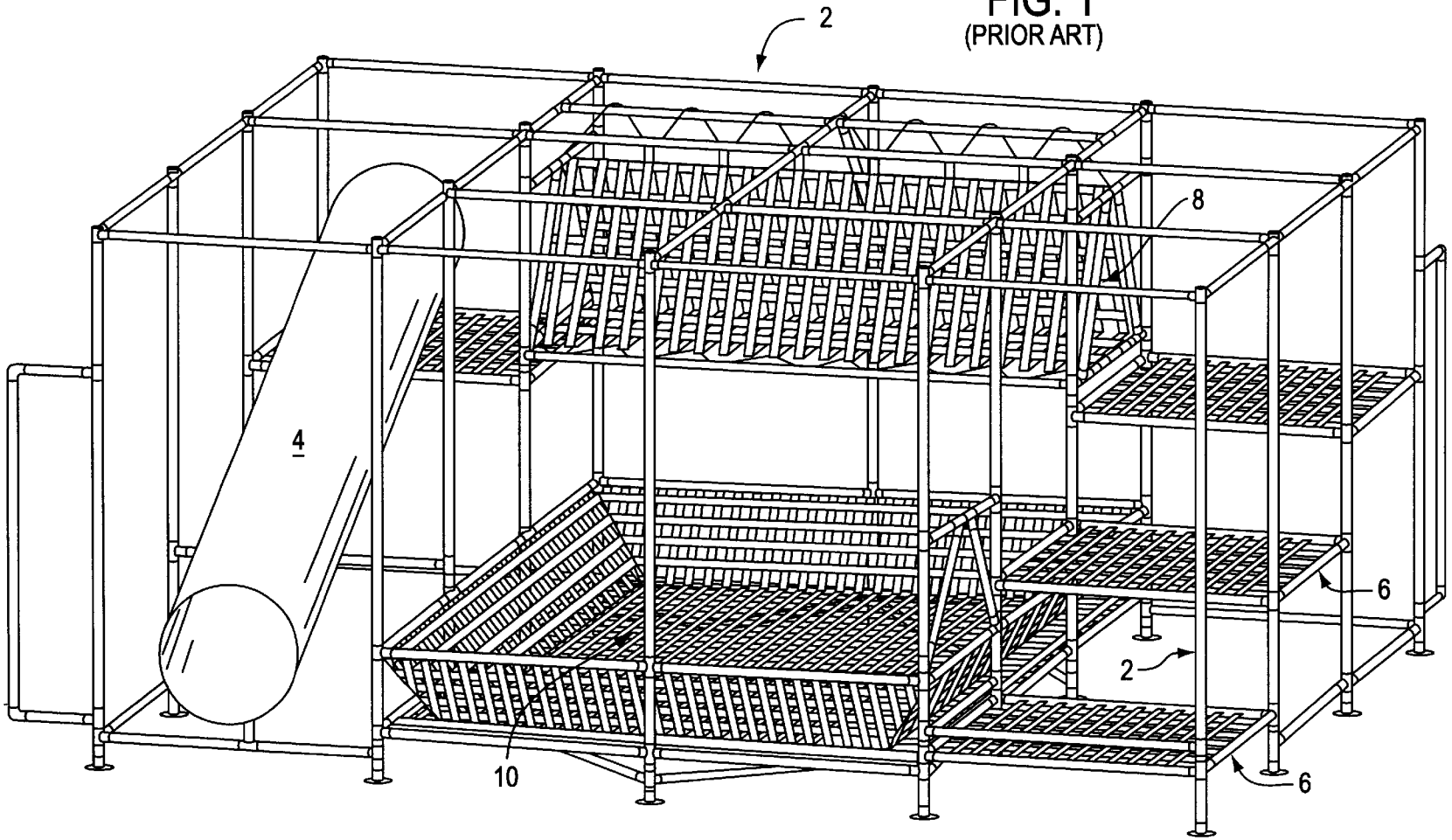
FIG. 1 (PRIOR ART)
FIG. 1 is a perspective view of a typical play system.
Figure 5:
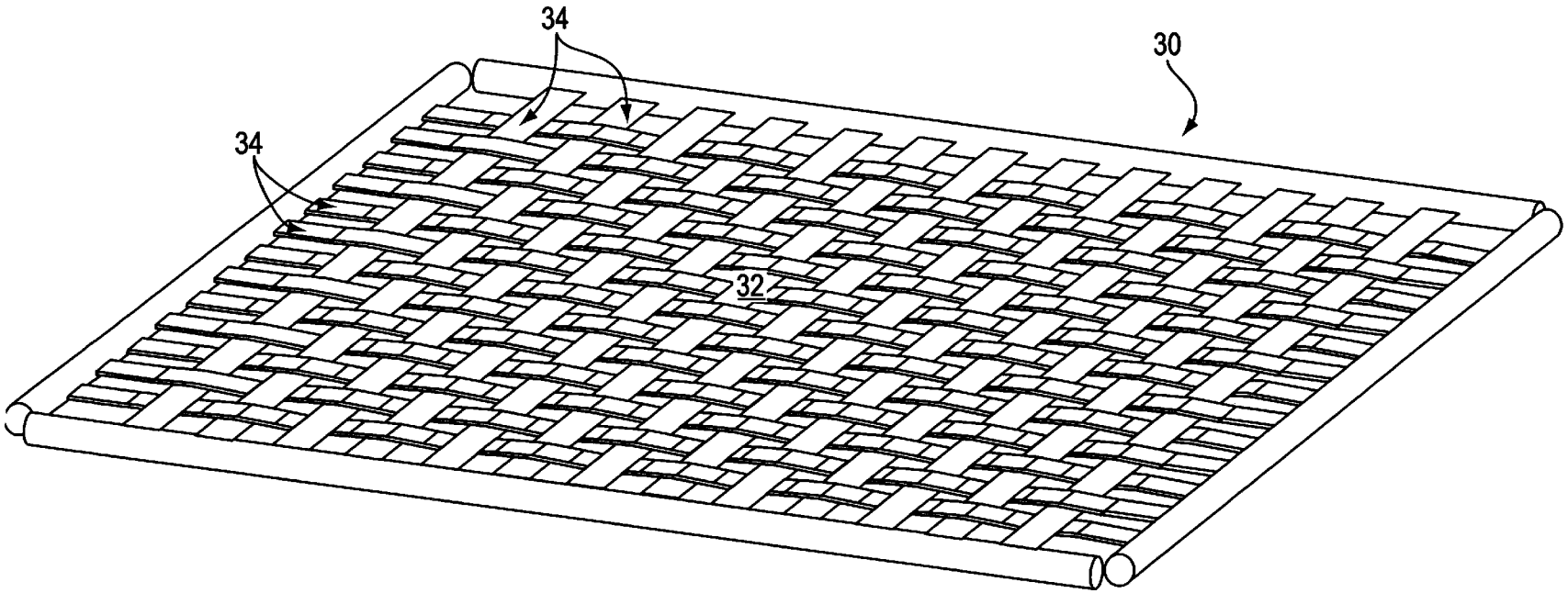
FIG. 5 shows a woven play system floor in accordance with the present invention.

FIG. 5 shows a play system floor in accordance with the present invention. The play system floor includes frame members 30 (corner connectors not shown) that extend around the periphery of the floor of a pay system, such as that shown in FIG. 1. In the preferred embodiment, frame members 30 are preferably constructed of Allied Tubing & Conduit brand 10 gauge 1.66" OD recreational structural tubing. Frame members 30 do not themselves form part of the present invention, and it is foreseen that the present invention is applicable for use with any appropriate type of frame member.

Formed within the frame 30 is a floor 32 that is constructed of flexible webbing, preferably National Webbing brand 2" wide nylon webbing (Herringbone Style—No. 002) that is woven as shown so that each web alternately passes above then below the webbing oriented perpendicular thereto. The weaves are preferably separated by 2" so that it is possible to see through the floor. It is foreseen that any type of appropriate webbing, including those having other weave patterns and those made of other materials, including polyester, may be used in lieu of the preferred webbing.

Figure 2:
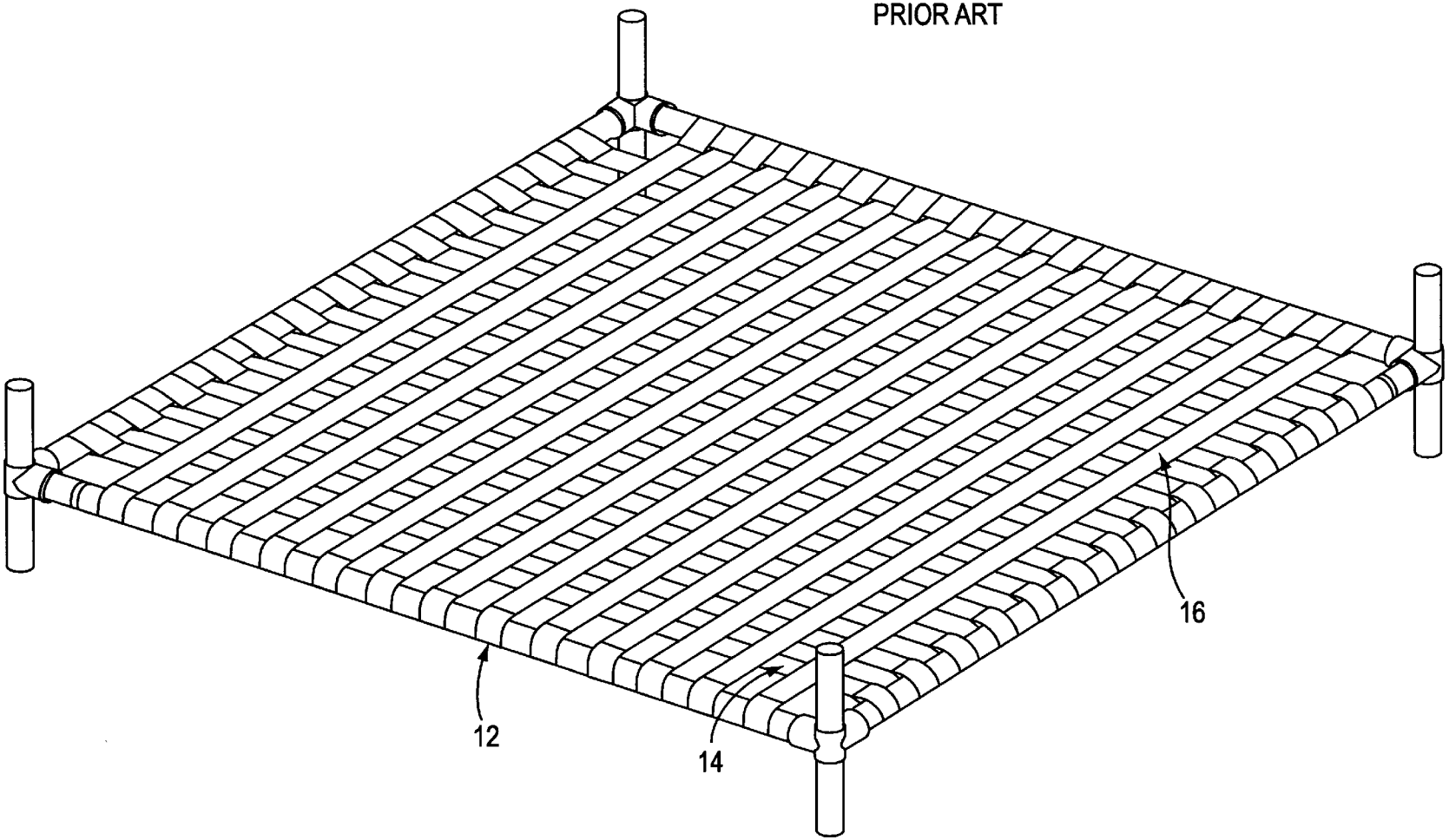
FIG. 2 PRIOR ART
FIG. 2 is a perspective view of a prior art play system floor which is constructed of layered webbing.
Figure 3:
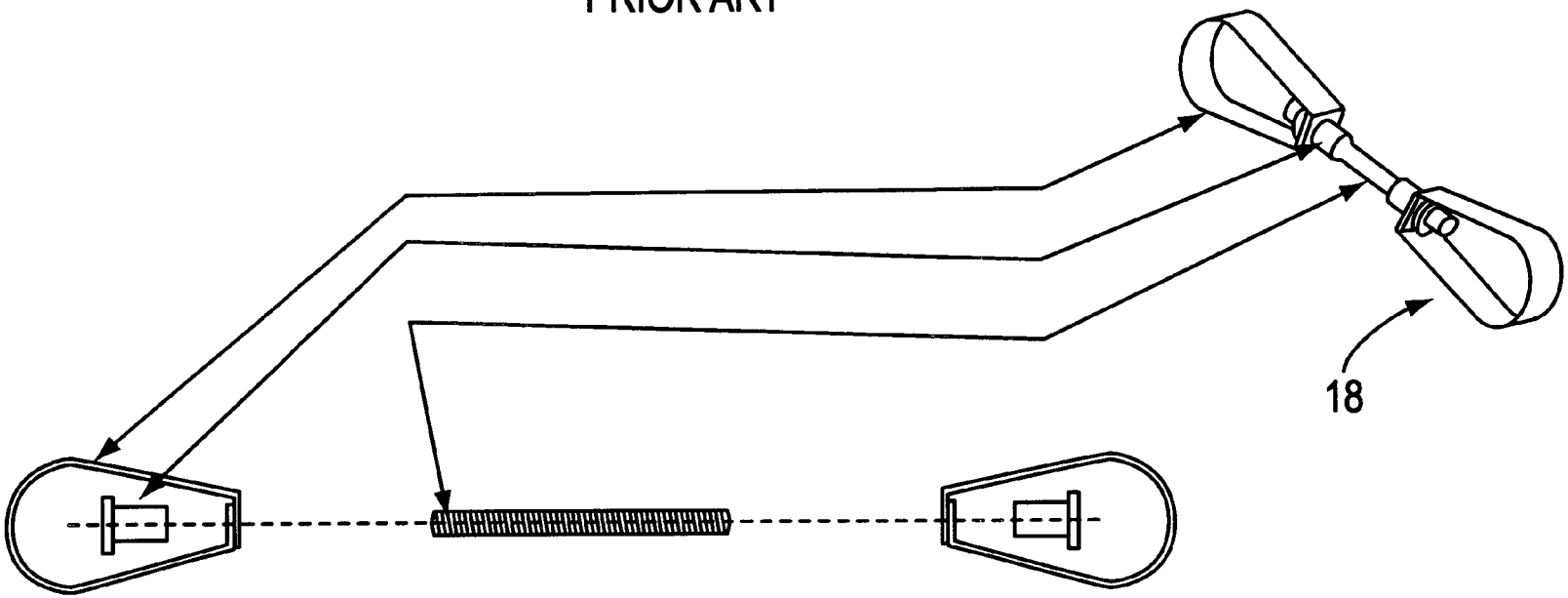
FIG. 3 PRIOR ART
FIG. 3 is a perspective view and an exploded view of a prior art floor tension harness.
Figure 4:
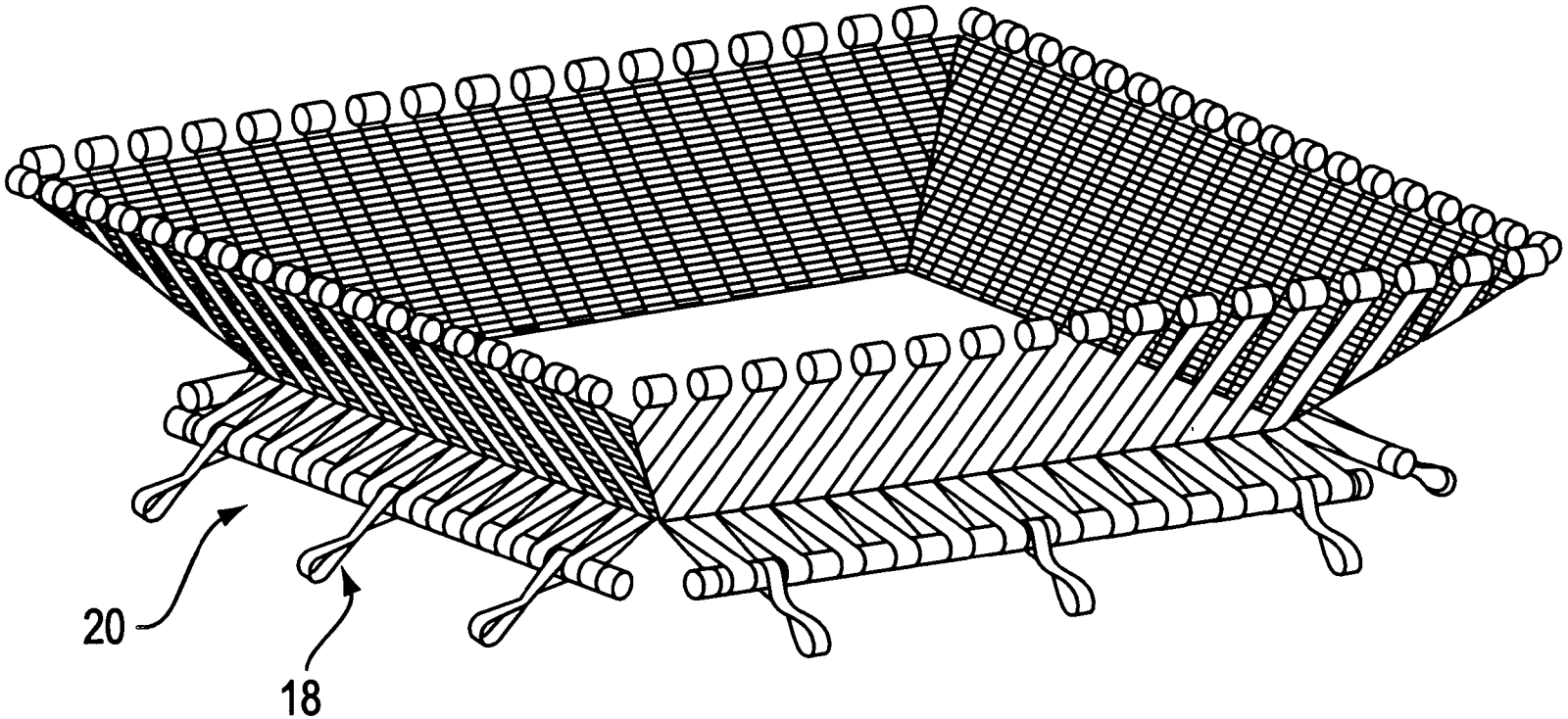
FIG. 4 PRIOR ART
FIG. 4 is a perspective view of a prior art system for tensioning the floor of a play system.
Figure 7:
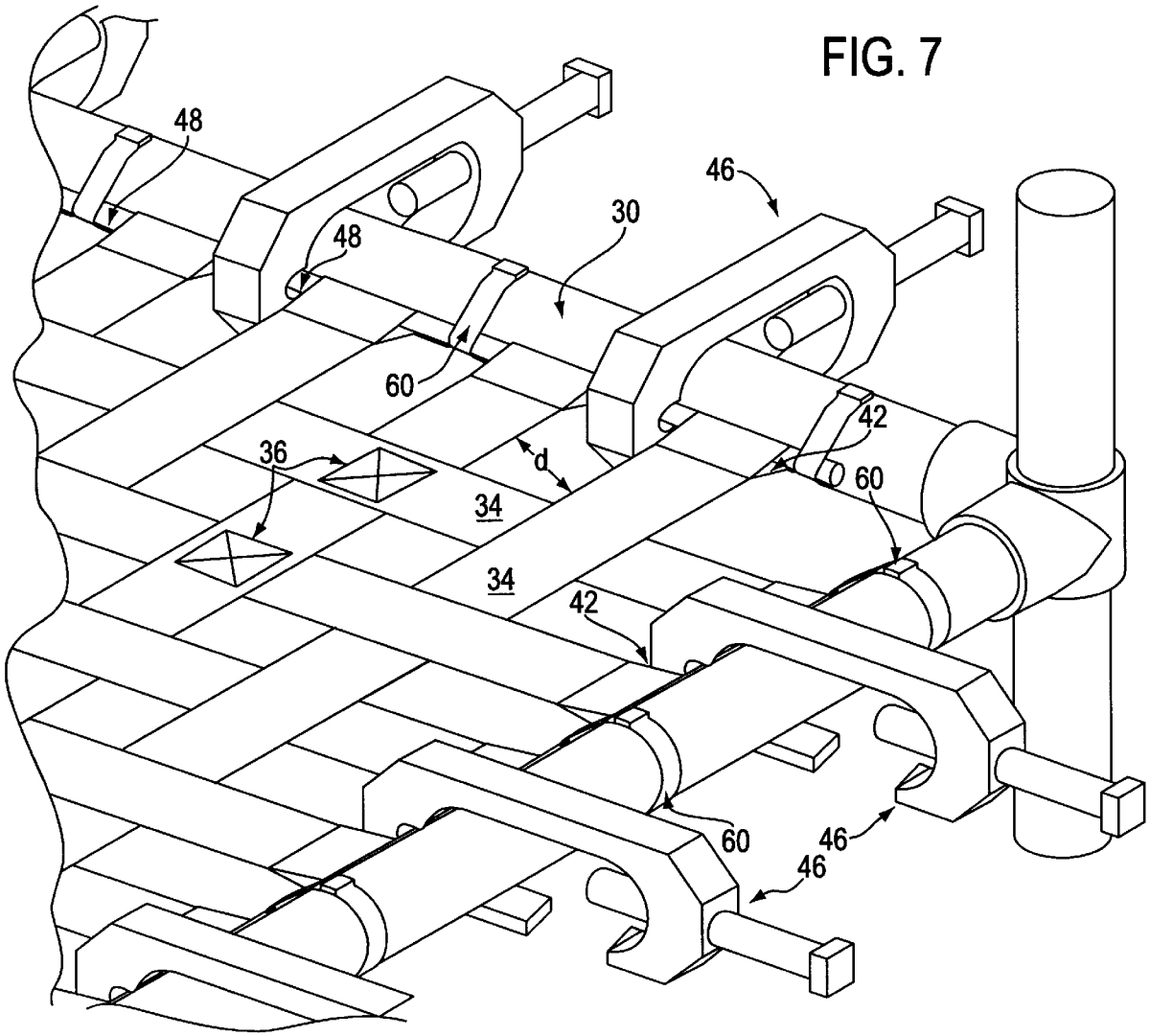
FIG. 7 is an exploded perspective view showing the play system floor tensioning system of the present invention.

As shown in detail in FIG. 7, at the intersections at which the straps cross one another, the straps are attached to each other by means of conventional stitching 36 preferably using, a box and cross stitch. The stitching 36 is preferably in a square pattern having an open "X" pattern therein as shown. It will be appreciated that straps 34 may be attached to each other by any type of stitching or any conventional fastening means. Because the floor 32 is woven, even if the stitching 36 were due to tear, the floor 32 would retain its structural integrity due to the interlocking nature of the weave patter and the tension that is put on the web strap. In contrast, in prior art nylon-weaved floors such as shown in FIG. 2, when the stitching tears, the floor will tend to separate. It will be appreciated that the weaved floor of the present invention will function effectively without stitching 36.

Figure 6:
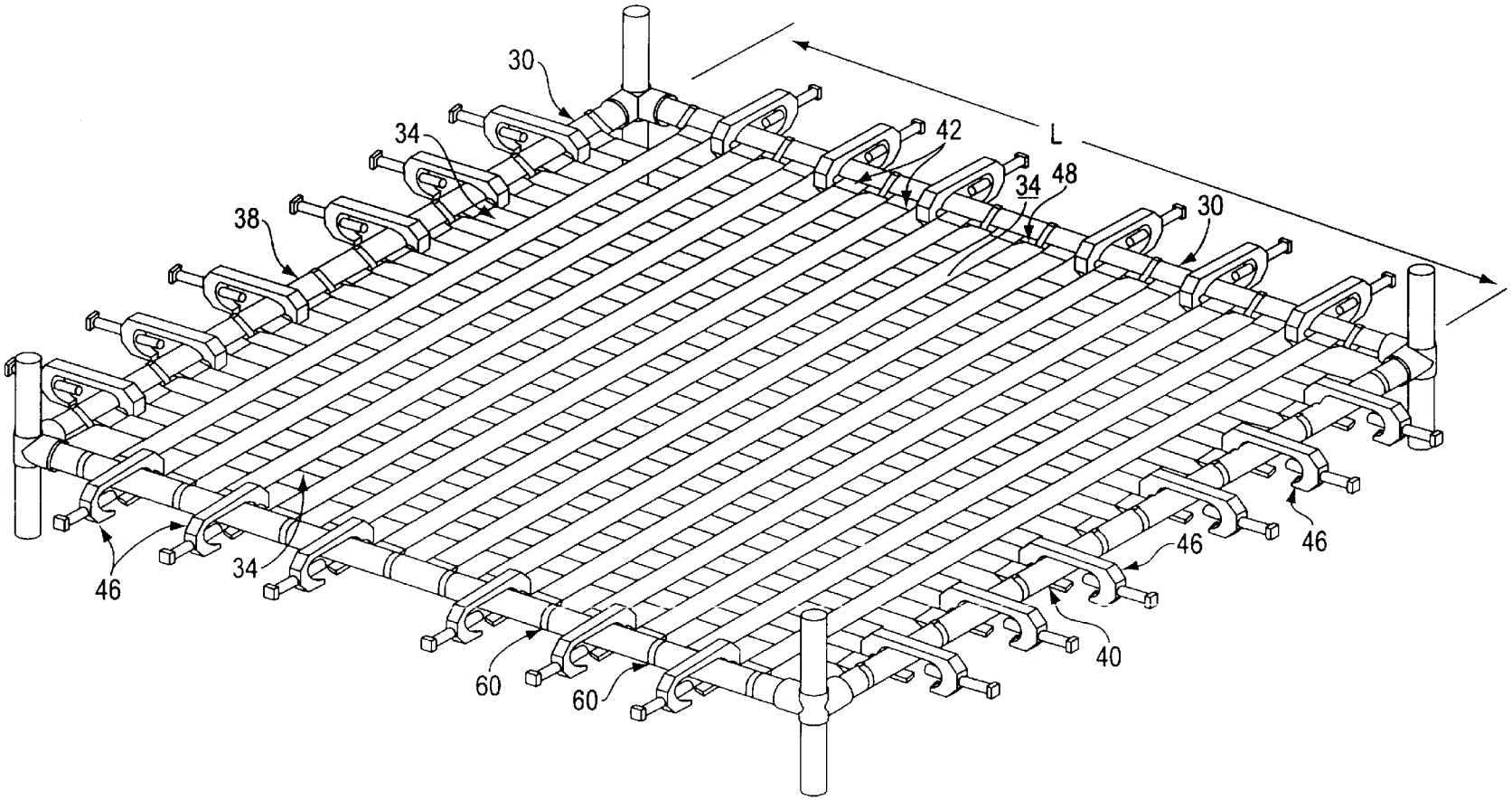
FIG. 6 is a perspective view showing the play system floor tensioning system of the present invention.

As previously discussed and as shown in FIG. 7, web members 34 are preferably 2 inch wide nylon strips, with a 2 inch gap "d" extending between adjacent webs 34. Weaved floor 32 is installed in frame 30 under an amount of tension that will not damage the nylon webbing but that stretches the nylon webbing a sufficient amount so that it will retain its tension even under prolonged use. In order that the webbing 34, when tensioned, will properly fit within the dimensions of frame 30, the individual web members are sized shorter than the dimensions of the frame 30. For example, as shown in FIG. 6, if an individual web member 34 is to be attached between opposed frame members 38 and 40 having an inside dimension length "L" between them, web member 34 is made slightly shorter than the length "L" by a predetermined amount based upon the optimal tension for web member 34.

For the preferred webbing, the webbing is preferably stretched 0.00885 inches per inch to achieve the desired degree of tension. Thus, for example, if it is desired to have an installed strap length of 58.25 inches, i.e., the length "L" is 58.25 inches, then each web strap must be made 57.74 inches (58.25−(58.25×0.00885) in order to have the proper amount of tension on the strap when it is installed between frame members that are 58.25 inches apart. The preferred tension for different straps or straps made of other materials may be the amount of tension required to cause a slight deflection in the 13 gauge 1.66" OD frame members. Alternatively, a tension that will not damage the webbing material but that stretches the webbing a sufficient amount so that it will retain its tension under prolonged use may be determined by testing.

Each web member 34 preferably includes a loop 42 at each end thereof. Each loop 42 is formed by folding web 34 on to itself, and then sewing the folded-over portion to the web. In order to install the net within the frame, a relatively rigid rod 48, preferably constructed of solid, cold-rolled steel, is inserted through the loops at the ends of each web strap 34, as shown in FIGS. 6 and 7. As shown in FIG. 6, the tensioning system of the invention is applicable to a floor in which the straps are not weaved. Rod 48 is preferably 55.125 inches long for a frame having a length "L" of 58.25 inches.

Figure 8:
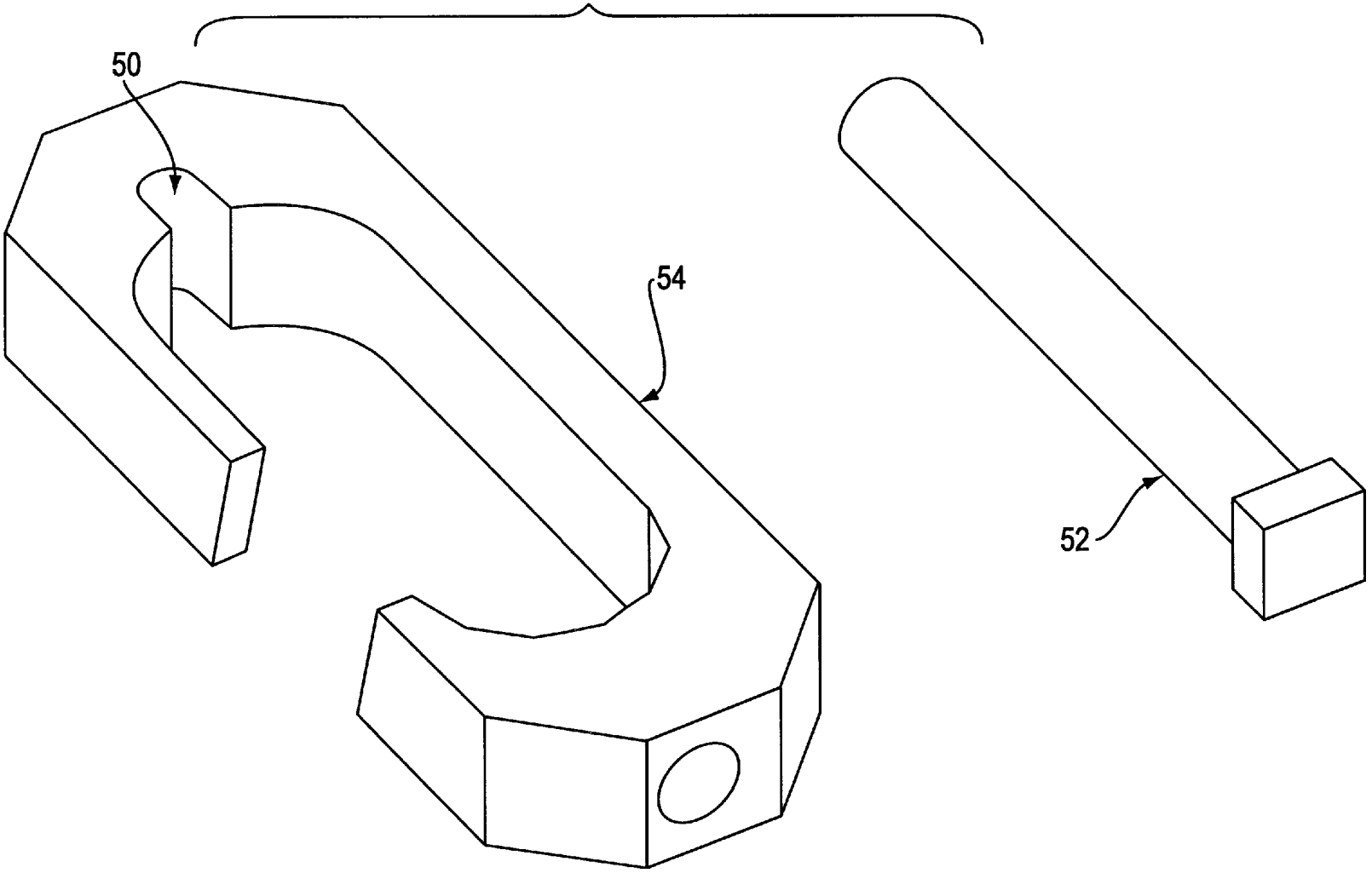
FIG. 8 shows a tensioning bracket in accordance with the present invention.

Net stretch brackets 46 are attached around and engage with frame members 30 and also engage with rods 48 that fit within cutaway 50, as shown in FIGS. 7 and 8. Each bracket 46 includes a threaded set screw 52 (threading not shown) which is screwed down through a clamp member 54. Clamp members 54 preferably measure approximately 7¼" long× 2⅜" high×1" wide. Once rod 48 is inserted into cutaways 50, the threaded set screws 52 are tightened down to pull rods 48 against frame members 30. A number of brackets 46 may be used to tension each side of the floor (FIG. 6). Threaded set screws 52 are preferably systematically screwed down to achieve even positioning of the net within the frame 30. When all of the threaded bolts 52 are screwed down so that rods 48 are pressed firmly against frame 30, the webbed floor 32 is at the proper tension. Finally, clamps or bands 60 are attached around the frame 30 and rods 48 to secure the rods to the frame with the play system floor under the desired tension. Any appropriate clamp 60 may be utilized, such as those manufactured by BAND-IT-IDEX™, Inc.

Figure 9:
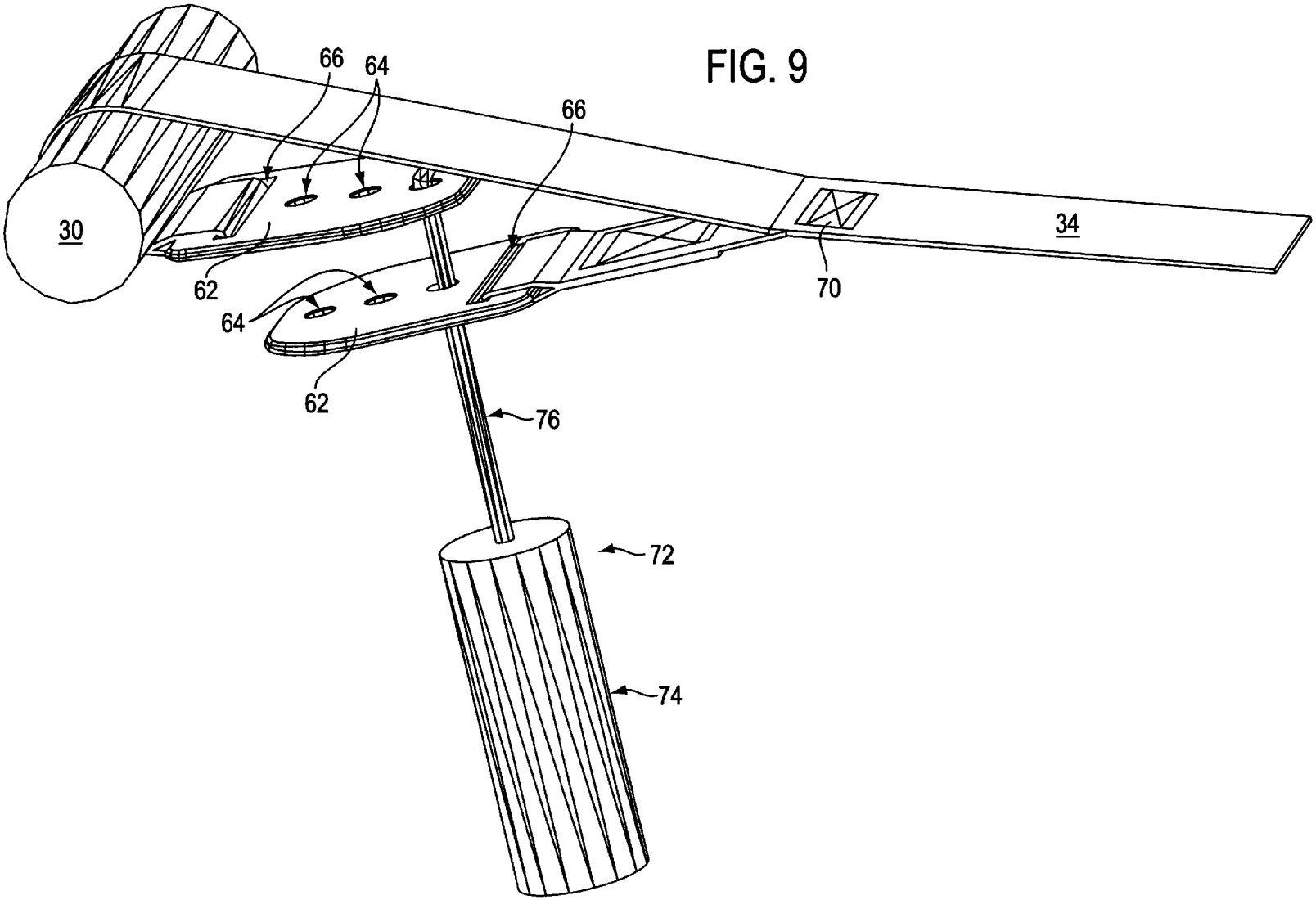
FIG. 9 shows an alternative tensioning method in accordance with the invention in which the attachment brackets are being tensioned.
Figure 10:
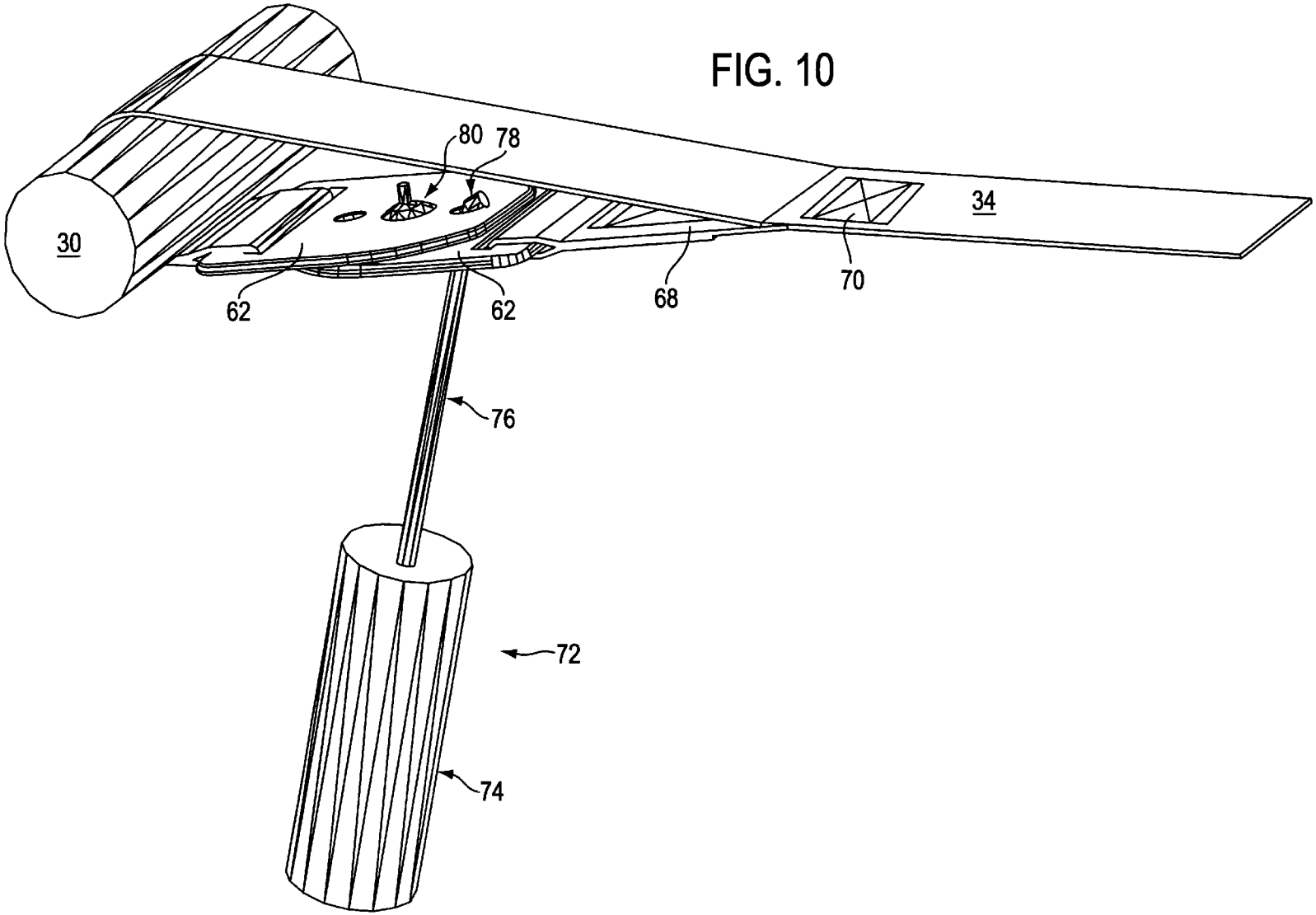
FIG. 10 shows the attachment brackets of FIG. 9 in an attached and tensioned position.

In an alternative embodiment of the invention, as shown in FIGS. 9 and 10, webbed members 34 are attached to frame members 30 by means of attachment brackets 62. Each of the attachment brackets 62 is preferably constructed of a relatively hard plastic material, such as DuPont™ Delrin™ 100, although any material of sufficient strength may be used. Plastic is preferred due to its relatively low cost light weight and corrosion resistance. Attachment brackets 62 are preferably identical, in order to reduce costs, and include a plurality, and preferably three, alignment and attachment holes 64 extending therethrough. The brackets and web members are sized such that the holes 64 are in alignment when the floor is stretched to a desired tension.

Each web member 34 has a free end that is attached to bracket 62 by being looped through a slot 66 in the bracket and by being stitched back to itself using conventional stitching. A strap 68, which is preferably constructed of the same material as web members 34, is attached to each web member 34 by means of stitching 70. Strap 68 is looped through slot 66 of bracket 62 and is then stitched back to itself using conventional stitching. Optionally, strap 68 may be eliminated and the second bracket may be attached to web member 34 at an appropriate location (based upon the desired tension of the floor) by any appropriate attachment technique.

To attach the webbed floor to frame 30, the free end of each web member, and bracket 62 attached thereto, are looped around frame member 30 and into proximity with the other bracket 62 and strap 68. An alignment tool 72 is then used to apply adequate tension to brackets 62 to bring holes 64 into alignment, as required. Alignment tool 72 preferably consists of a handle 74, which may be constructed of a plastic material, and a shaft 76, which is preferably constructed of steel or other strong metal. The end 78 of shaft 76 may be bent slightly in order to make alignment of the holes easier. Prior to use of the alignment tool 72, holes 64 are somewhat separated, since the web members must be stretched for the floor to be at the desired tension. Alignment tool 72 is extended through the front hole of one bracket 62 and through the rear hole of the other bracket 62, and pressure is applied to align the holes. When the holes through which the alignment tool is inserted are aligned, all of the holes on each bracket 62 fall into alignment. A drive rivet 80 is then driven through the center hole of each bracket by means of pliers or the like to attach the brackets together. Drive rivet 80 is preferably a conventional drive rivet such as Full Brazier Head Aluminum Drive Rivets from Southco, Inc.™ or Imperial™. Alternatively, any appropriate attachment method, such as nuts/bolts, may be used to attach the brackets 62. Likewise, any appropriate alignment tool 72, e.g., a pry bar or screwdriver, may be used to align the brackets. Using this method of the invention, a play system floor having a desired predetermined tension may be assemble with a simple alignment tool and with relatively inexpensive brackets that remain attached to the play system.

Although the present invention has been described in detail with respect to certain embodiments and examples, variations and modifications exist which are within the scope of the present invention as defined in the following claims.

We claim:

1. A play system floor which comprises:

a rigid frame defining the periphery of an area to be floored;

a webbed flooring comprising a webbing material having ends along an outer periphery of the webbed flooring;

a plurality of first attachment brackets, each attached to an end of the webbing material and looped around the rigid frame with the webbing material;

a plurality of second attachment brackets, each attached to the webbing material adjacent an end thereof, wherein each first and second attachment bracket comprises alignment holes; and attachment means securing each first attachment bracket to a respective second attachment bracket with tension applied to the webbed flooring wherein the attachment means comprises a rivet or bolt extending through aligned alignment holes in the first and second attachment brackets whereby the alignment holes are in alignment at the desired tension.

2. The play system floor according to claim 1 wherein the webbing material is sized, and the first and second attachment brackets are positioned, so that upon attachment of the first attachment bracket to a respective second attachment bracket, the webbed flooring is at a desired tension.

3. The play system floor according to claim 1 further comprising a strap attaching each second attachment bracket to the webbing material.

4. The play system floor according to claim 1 further comprising a strap attaching each second attachment bracket to the webbing material, and the webbing material and strap being sized whereby upon alignment of the alignment holes in the first and second attachment brackets, the webbed flooring is at a desired tension.

5. The play system floor according to claim 1 wherein the first and second attachment brackets are constructed of plastic.

6. A method of assembling a play system floor in a frame defining the periphery of an area to be floored, the method comprising the steps of:

providing a rigid frame;

providing a webbed floor constructed of a webbing material having ends;

providing a first attachment bracket comprising alignment holes attached to each end of the webbing material;

providing a second attachment bracket comprising alignment holes attached to the webbing material adjacent each end thereof;

looping each end of the webbing material and the first attachment bracket around the rigid frame; and attaching the first attachment bracket to the second attachment bracket by placing a rivet or bolt through the alignment holes wherein the alignment holes of the alignment brackets are aligned to provide a desired tension to the webbed floor.

7. The method according to claim 6 wherein the webbing material is sized, and the first and second attachment brackets are positioned, whereby upon attachment of the first attachment bracket to the second attachment bracket, the webbed flooring is at a desired tension.

8. The method according to claim 6 further wherein a strap attaches the second attachment bracket to the webbing material.

9. The method according to claim 6 wherein a strap attaches the second attachment bracket to the webbing material, and, the webbing material and strap being sized whereby upon alignment of the alignment holes in the first and second attachment brackets, the webbed flooring is at a desired tension.

* * * * *